US011355869B2

(12) United States Patent
Brand et al.

(10) Patent No.: US 11,355,869 B2
(45) Date of Patent: Jun. 7, 2022

(54) CABLE CONNECTOR FOR ELECTRICALLY CONNECTING ELECTRICAL CONDUCTORS

(71) Applicant: PHOENIX CONTACT GmbH & Co. KG, Blomberg (DE)

(72) Inventors: Niklas Brand, Extertal (DE); Frank Mellies, Detmold (DE); Markus Lewandowski, Detmold (DE); Frank Bulmahn, Schieder-Schwalenberg (DE); Jens Andresen, Blomberg (DE)

(73) Assignee: PHOENIX CONTACT GmbH & Co. KG, Blomberg (DE)

( * ) Notice: Subject to any disclaimer, the term of this patent is extended or adjusted under 35 U.S.C. 154(b) by 0 days.

(21) Appl. No.: 16/980,589

(22) PCT Filed: Mar. 11, 2019

(86) PCT No.: PCT/EP2019/055973
§ 371 (c)(1),
(2) Date: Sep. 14, 2020

(87) PCT Pub. No.: WO2019/175085
PCT Pub. Date: Sep. 19, 2019

(65) Prior Publication Data

US 2021/0057831 A1 Feb. 25, 2021

(30) Foreign Application Priority Data

Mar. 14, 2018 (BE) ..... 2018/5155

(51) Int. Cl.
*H01R 4/24* (2018.01)
*H01R 4/48* (2006.01)
*H01R 13/74* (2006.01)

(52) U.S. Cl.
CPC ..... *H01R 4/4836* (2013.01); *H01R 13/746* (2013.01)

(58) Field of Classification Search
CPC .. H01R 4/2433; H01R 4/2429; H01R 9/0757; H01R 4/2404
(Continued)

(56) References Cited

U.S. PATENT DOCUMENTS 2,962,688 A * 11/1960 Werner ..... H01R 13/5219 439/320
6,093,052 A 7/2000 Wang
(Continued)

FOREIGN PATENT DOCUMENTS

CN 107112648 8/2017
DE 4016770 11/1991
(Continued)

OTHER PUBLICATIONS

PCT Search Report for corresponding PCT Application No. PCT/EP2019/055973 dated Apr. 8, 2019, 13 pages.
(Continued)

*Primary Examiner* — Phuong Chi Thi Nguyen
(74) *Attorney, Agent, or Firm* — Lee & Hayes, P.C.

(57) ABSTRACT

A cable connector for electrically connecting at least one first electrical conductor to at least one second electrical conductor. The cable connector includes an insulating-material housing, which has at least one first conductor insertion opening and at least one second conductor insertion opening. The second conductor insertion opening is opposite the first conductor insertion opening. The cable connector has at least one electrical contact in the insulating-material housing. The least one electrical contact is electrically contacted by a first electrical conductor via the first conductor insertion opening and by a second electrical conductor via the second conductor insertion opening. The first electrical conductor is loaded against the electrical contact via a first clamping spring and the second electrical conductor is
(Continued)

Figure 1A:
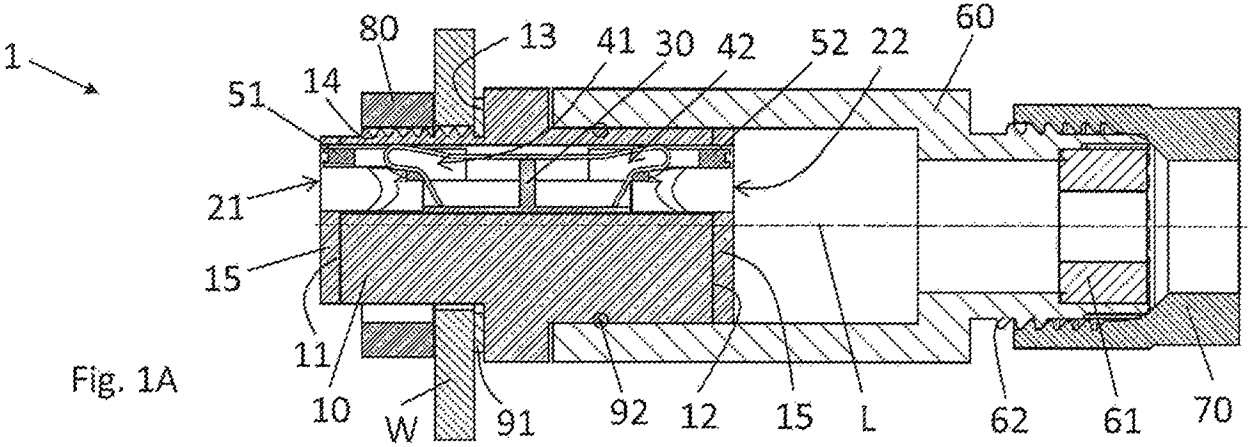

loaded against the electrical contact via a second clamping spring such that the first electrical conductor is electrically connected to the second electrical conductor by means of the electrical contact.

13 Claims, 5 Drawing Sheets

(58) Field of Classification Search
USPC ..... 439/584, 578, 583, 585, 320, 321, 461, 439/462
See application file for complete search history.

(56) References Cited

U.S. PATENT DOCUMENTS

| | | | | |
|---|---|---|---|---|
| 8,262,405 | B1 | 9/2012 | Bishop | |
| 9,537,232 | B2 * | 1/2017 | Hanson | H01R 4/10 |
| 10,033,119 | B2 | 7/2018 | Koellmann | |
| 2005/0181681 | A1 | 8/2005 | Arai et al. | |
| 2009/0017699 | A1 | 1/2009 | Breen IV | |
| 2017/0331200 | A1 | 11/2017 | Koellmann | |

FOREIGN PATENT DOCUMENTS

| | | |
|---|---|---|
| DE | 20205823 | 8/2003 |
| DE | 10255190 | 6/2004 |
| DE | 102007006645 | 8/2008 |
| DE | 102010034881 | 2/2012 |
| DE | 202011050587 | 10/2012 |
| DE | 102014119421 | 6/2016 |
| DE | 202016106319 | 2/2018 |
| WO | WO2014178041 | 11/2014 |
| WO | WO2016083966 | 6/2016 |

OTHER PUBLICATIONS

Chinese First Office Action in Chinese text, related U.S. Appl. No. 16/980,589, 10 pages.
Chinese First Office Action in English text, related U.S. Appl. No. 16/980,589, 11 pages.
Chinese First Office Action with English text, for corresponding CN Patent Application No. 201980017098.2 dated Nov. 8, 2021, 19 pages.

* cited by examiner

CABLE CONNECTOR FOR ELECTRICALLY CONNECTING ELECTRICAL CONDUCTORS

This Application claims priority to PCT Application No. PCT/EP2019/055973, filed Mar. 11, 2019, which claims priority to Belgian Patent Application No. BE2018/5155, filed Mar. 14, 2018, the contents of each of which is incorporated herein by reference.

The present invention relates to a cable connector for electrically connecting at least one first electrical conductor to at least one second electrical conductor.

It is known from the prior art to use cable connectors in combination with wall ducts for connecting an electrical conductor to an electrical device, for example, to a lamp or a switchgear cabinet. For this purpose, the wall duct is mounted on the device and can be wired internally. On the field side, i.e., outside the electrical device, the electric cable is connected to a cable connector and the contact point is protected against tensile stress, for example, by a cable gland. The connected cable connector can subsequently be plugged into the wall duct located on the device.

A combination of cable connector and wall duct is disadvantageous because two separate components are required for wiring and for guiding electrical conductors to the outer side of the electrical device. In addition, a further contact point is introduced between the cable connector and the wall duct.

It is further known from the prior art to use a cable gland, in which the electric cable is guided through the cable gland and internally connected in the device and subsequently tightened.

A respective cable gland is very cumbersome to operate for a user and does not allow for a device-internal wiring by robot.

The problem addressed by the present invention is that of providing a cable connector which allows for a simplified electrical contacting of electrical conductors (electric cables, wires) within the electrical device with electrical conductors (electric cables, wires) outside the electrical device.

The problem addressed by the present invention is solved by a cable connector with the features of claim 1 of the present invention. Advantageous embodiments of the cable connector are described in the claims dependent on claim 1.

More specifically, the problem addressed by the present invention is solved by a cable connector for electrically connecting at least one first electrical conductor to at least one second electrical conductor, wherein the cable connector has an insulating-material housing, which has at least one first conductor insertion opening and at least one second conductor insertion opening, wherein the second conductor insertion opening is arranged opposite the first conductor insertion opening. The cable connector further has at least one electrical contact arranged in the insulating-material housing, which can be electrically contacted by means of a first electrical conductor via the first conductor insertion opening and by means of a second electrical conductor via the second conductor insertion opening. The first electrical conductor can be loaded against the electrical contact by means of a first clamping spring and the second electrical conductor can be loaded against the electrical contact by means of a second clamping spring, so that the first electrical conductor is electrically connected to the second electrical conductor by means of the electrical contact.

The cable connector according to the invention, which can also be called a round cable connector or a plug-in connector or a round plug-in connector, has the advantage that an electrical device equipped with the cable connector according to the invention can be wired device-internally and subsequently shipped without the electrical device equipped with the cable connector according to the invention having to be opened again for a final assembly. Therefore, the electrical device equipped with the cable connector according to the invention is protected from environmental influences because in the field, e.g., at an end consumer, the electrical device does not have to be opened again for a further electrical connection. Furthermore, an electrical device equipped with the cable connector according to the invention can be internally wired by means of a robot.

The cable connector is preferably designed to be arranged in an opening of a wall/housing wall, so that an electrical conductor arranged within a housing can be electrically connected to a further electrical conductor (e.g., an external electrical conductor).

Further preferably, the cable connector is designed to generally electrically connect two electrical conductors. Therefore, the cable connector does not necessarily have to be arranged in an opening of a wall/housing wall. The cable connector is thus designed to be used in the field, wherein the two electrical conductors to be connected are located freely in the field, i.e., for example, they are not arranged within a housing.

The first and the second electrical conductors are, for example, electric cables which are stripped at least at the ends to be inserted into the cable connector.

The insulating-material housing is made of a dielectric material, preferably a plastic.

The first conductor insertion opening can also be called a device-side conductor insertion opening. The second conductor insertion opening can also be called a field-side conductor insertion opening.

The electrical contact device is formed from an electrically conducting material, preferably steel and/or copper and/or brass or another metal or another metal alloy.

The first conductor insertion opening and the second conductor insertion opening are each arranged in respective opposite end faces of the insulating-material housing. The first conductor insertion opening is formed with the second conductor insertion opening preferably via a through-recess running through the insulating-material housing.

The insulating-material housing preferably has a stop area which can be brought into contact with a wall surrounding a through-opening (of a housing wall).

The insulating-material housing preferably has a first number of first conductor insertion openings and a second number of second conductor insertion openings, wherein the second number does not differ from the first number.

The insulating-material housing preferably has at least two first conductor insertion openings and a number of second conductor insertion openings, the number of which corresponds to the number of first conductor insertion openings, wherein the second conductor insertion openings are arranged opposite the first conductor insertion openings, wherein the cable connector has electrical contacts arranged in the insulating-material housing, the number of which corresponds to the number of first conductor insertion openings, and each electrical contact can be electrically contacted by means of a first electrical conductor via a first conductor insertion opening and by means of a second electrical conductor via a second conductor insertion opening, and wherein the respective first electrical conductors can be loaded against an electrical contact by means of a first clamping spring and the respective second electrical conductors can be loaded against an electrical contact by means of a second clamping spring, so that a first electrical conductor is electrically connected to a second electrical conductor by means of an electrical contact.

A correspondingly designed cable connector has the advantage that it is designed to connect at least two first electrical conductors to second electrical conductors, the number of which corresponds to the number of first electrical conductors.

Further preferably, the cable connector has at least one lid which is arranged on an end face of and connected to the insulating-material housing. Also further preferably, the cable connector has two lids, wherein a first lid is arranged on the first end face of the insulating-material housing, and a second lid is arranged on the second end face of the insulating-material housing. The lids each have through-openings, through which the electrical conductors can be guided into the corresponding conductor insertion openings.

Further preferably, the cable connector is designed such that the insulating-material housing is designed as one piece.

A correspondingly designed cable connector has a reduced number of individual components, and with regard to its installation, for example, through a housing wall, it can be inserted in a simplified manner.

The cable connector is preferably designed such that the respective first electrical conductors can be brought into electrical contact with an electrical contact under elastic deformation of the respective first clamping springs via the corresponding first conductor insertion openings, and the respective second electrical conductors can be brought into electrical contact with an electrical contact under elastic deformation of the respective second clamping springs via the corresponding second conductor insertion openings.

A correspondingly designed cable connector has the advantage that both the first electrical conductors and the second electrical conductors can be inserted into the cable connector and electrically connected without tools. As a result, the correspondingly designed cable connector has an even more simplified and improved operability. An insertion of electrical conductors into the cable connector without tools is possible particularly in case of inflexible conductors and flexible cables provided with ferrules.

With a correspondingly designed cable connector, it is naturally also possible to insert a flexible electric conductor by means of a tool into one of the conductor insertion openings.

Preferably, the cable connector is designed such that the cable connector has first actuation devices, the number of which corresponds to the number of first clamping springs, wherein an actuation of a first actuation device transfers the first clamping spring, which is in contact with said first actuation device, under elastic deformation to a release position, in which the first electrical conductor is not loaded against the electrical contact by means of a first clamping spring, so that the first electrical conductor can be removed from the cable connector. Furthermore, the cable connector has second actuation devices, the number of which corresponds to the number of second clamping springs, wherein an actuation of a second actuation device transfers the second clamping spring, which is in contact with said second actuation device, under elastic deformation to a release position, in which the second electrical conductor is not loaded against the electrical contact by means of the second clamping spring, so that the second electrical conductor can be removed from the cable connector.

The actuation device can also be called a push-button. The first and/or second actuation devices are preferably arranged within the insulating-material housing.

Preferably, the cable connector is designed such that the at least two first conductor insertion openings have an angular distance to one another, and the at least two second conductor insertion openings have an angular distance to one another.

In this case, the angular distance of the first conductor insertion openings to one another is the angular distance in a top view of a first end face of the insulating-material housing. The angular distance of the second conductor insertion openings to one another is the angular distance in a top view of a second end face of the insulating-material housing, which is arranged opposite the first end face. In a top view of an end face of the insulating-material housing, the visual axis runs parallel to a longitudinal axis or symmetry axis of the insulating-material housing.

Preferably, the cable connector is designed such that the insulating-material housing has at least three first conductor insertion openings and at least three second conductor insertion openings, wherein the first conductor insertion openings are arranged in an angle equidistant manner to one another, and wherein the second conductor insertion openings are arranged in an angle equidistant manner to one another.

A correspondingly designed cable connector is constructed in a particularly compact manner. If the cable connector has, for example, three first conductor insertion openings and three second conductor insertion openings, the first conductor insertion openings each have an angular distance of 120° to one another, and the second conductor insertion openings each have an angular distance of 120° to one another.

Further preferably, the cable connector is designed such that the insulating-material housing has at least five first conductor insertion openings and at least five second conductor insertion openings. Preferably but not necessarily, the first conductor insertion openings are arranged in an angle equidistant manner to one another. Further preferably, the second conductor insertion openings are arranged in an angle equidistant manner to one another.

A correspondingly designed cable connector is constructed in a particularly compact manner because the first conductor insertion openings each preferably have an angular distance of 72° to one another, and the second conductor insertion openings each preferably have an angular distance of 72° to one another.

Preferably, the cable connector is designed such that the first actuation devices have the same angular distance to one another as the first conductor insertion openings, wherein the first actuation devices have a radial distance to the first conductor insertion openings. Furthermore, the second actuation devices have the same angular distance to one another as the second conductor insertion openings, wherein the second actuation devices have a radial distance to the second conductor insertion openings.

The correspondingly designed cable connector is also constructed in a particularly compact manner. The radial distance of the actuation devices to the conductor insertion openings provides for an improved accessibility of the actuation devices.

The actuation devices preferably have a greater radial distance to a longitudinal axis or symmetry axis of the insulating-material housing than the conductor insertion openings.

Preferably, the cable connector is designed such that the first clamping springs and the second clamping springs each have a contact limb and a clamping limb connected to said contact limb via a bending joint.

Due to the simple geometry of the clamping springs, the correspondingly designed cable connector can be produced in a cost-effective manner.

Preferably, the cable connector is designed such that the contact limbs each rest on an electrical contact.

With a corresponding design of the cable connector, it has a compact structure. In the case of a metallic design, the clamping springs are additionally also used for transferring electric current.

Preferably, the cable connector is designed such that the respective electrical contacts each have a stop section and two contact sections connected to the stop section, wherein a first contact section extends in the direction of a first conductor insertion opening, and a second contact section extends in the direction of a second conductor insertion opening.

Preferably, the cable connector is designed such that the contact limbs of the first and second clamping springs each rest on a stop section of an electrical contact.

Preferably, the cable connector is designed such that the cable connector has at least one slip-on sleeve which can be placed onto the insulating-material housing.

By means of the slip-on sleeve, the electrical conductors are protected from an excessive bending load. In addition, the slip-on sleeve provides further protection against environmental influences and, for example, moisture penetrating the cable connector. A further advantage is that the contact points between the electrical conductors and the cable connector are protected against tensile stress.

Further preferably, the cable connector is designed such that the at least one slip-on sleeve is designed as an elastic slip-on sleeve.

The elastic slip-on sleeve or the elastic slip-on sleeves is/are preferably designed as a bellows or bellows.

Further preferably, the cable connector is designed such that the cable connector has two slip-on sleeves, wherein a first slip-on sleeve can be placed onto a first end of the insulating-material housing, and a second slip-on sleeve can be placed onto a second end of the insulating-material housing.

Preferably, the cable connector is designed such that the cable connector has a cable gland which can be screwed together with the slip-on sleeve.

Figure 1B:
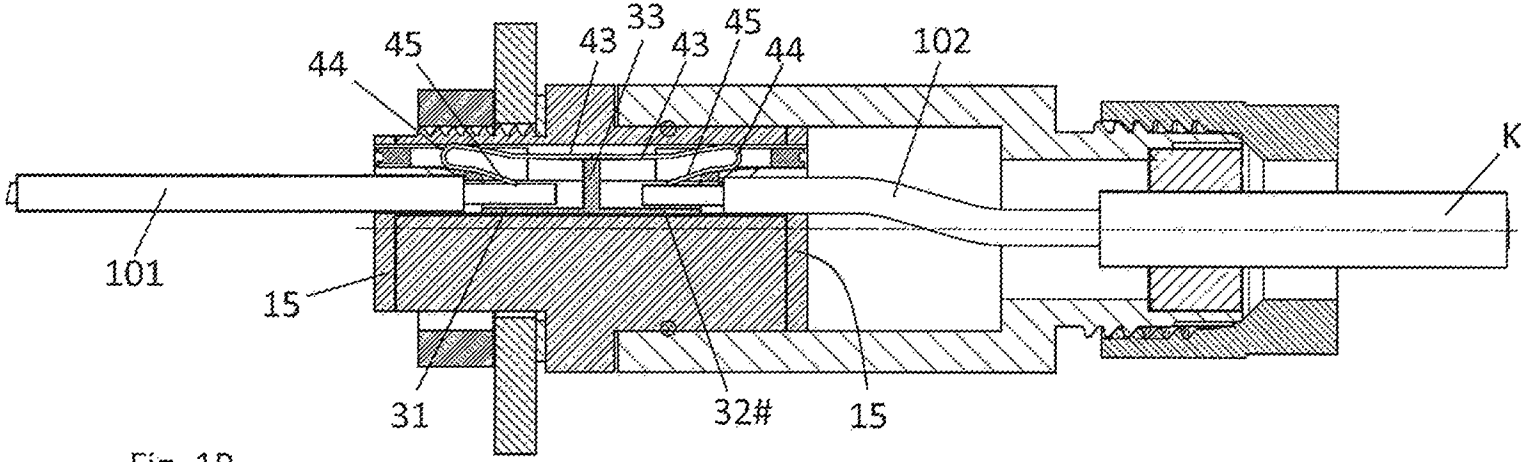
Figures 2A, 2B, 2C:
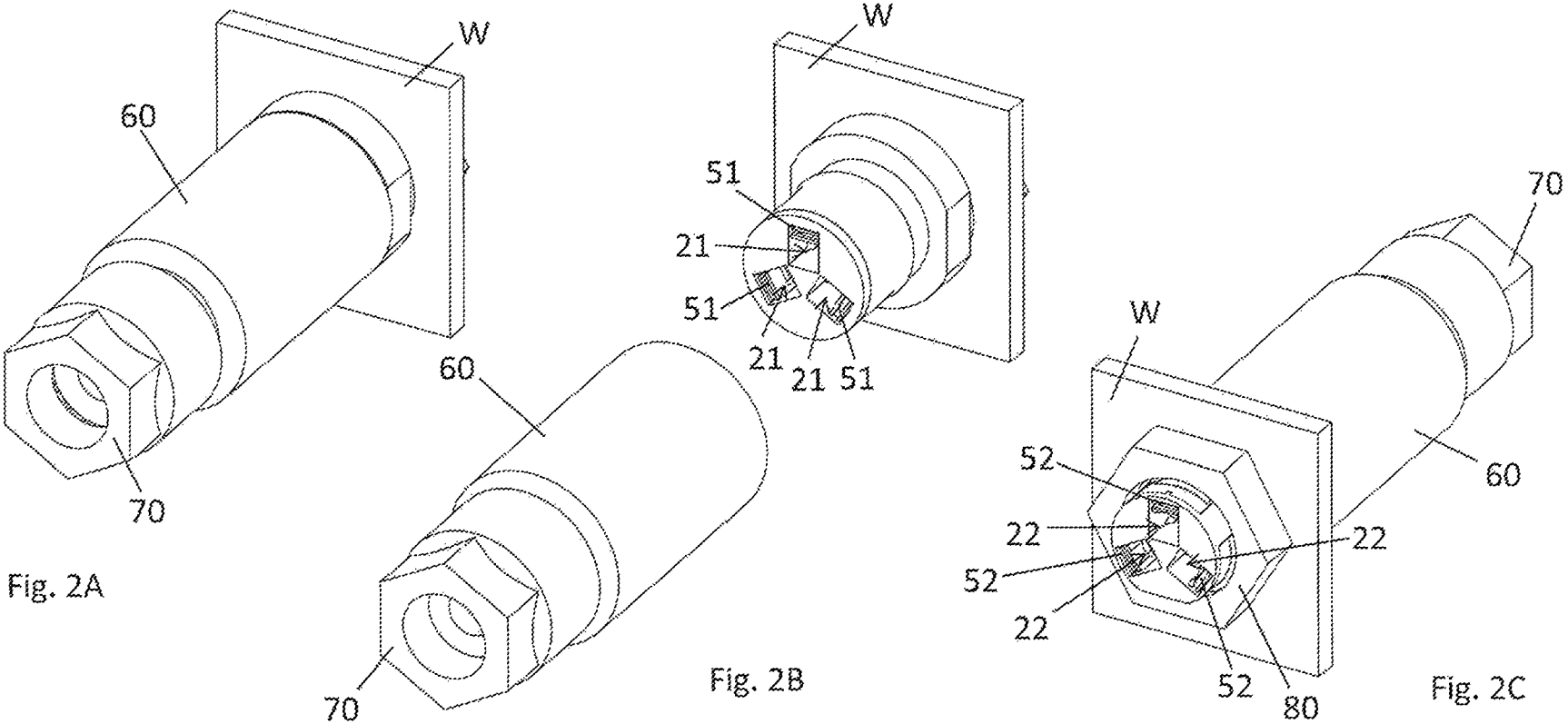
Figure 3A:
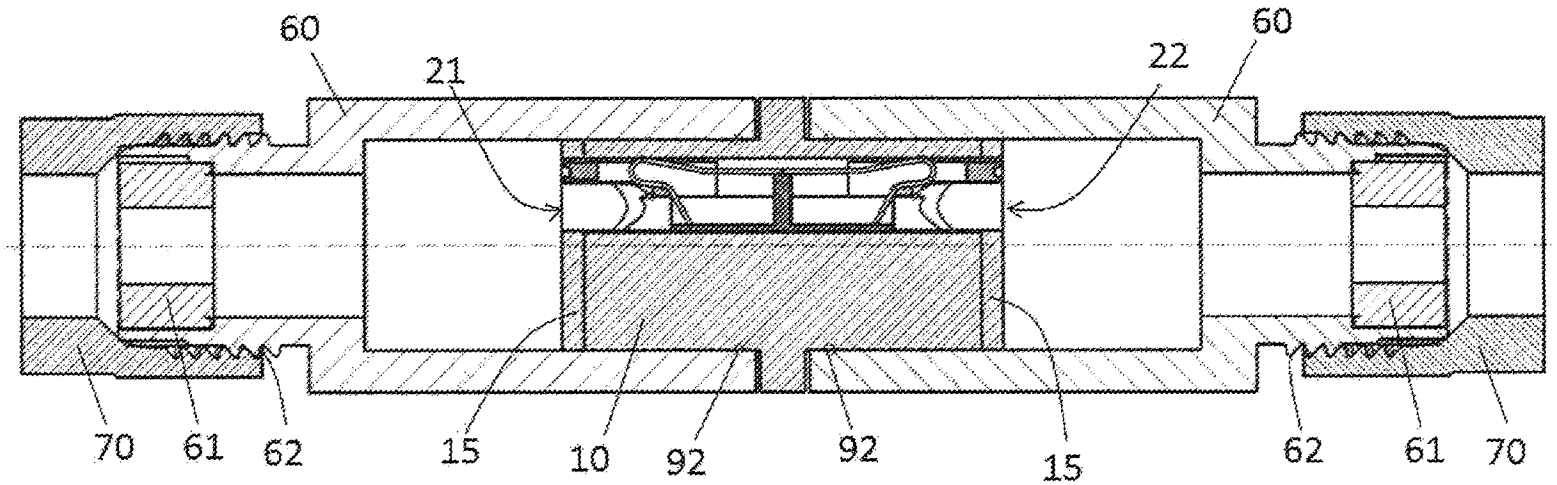
Figure 3B:
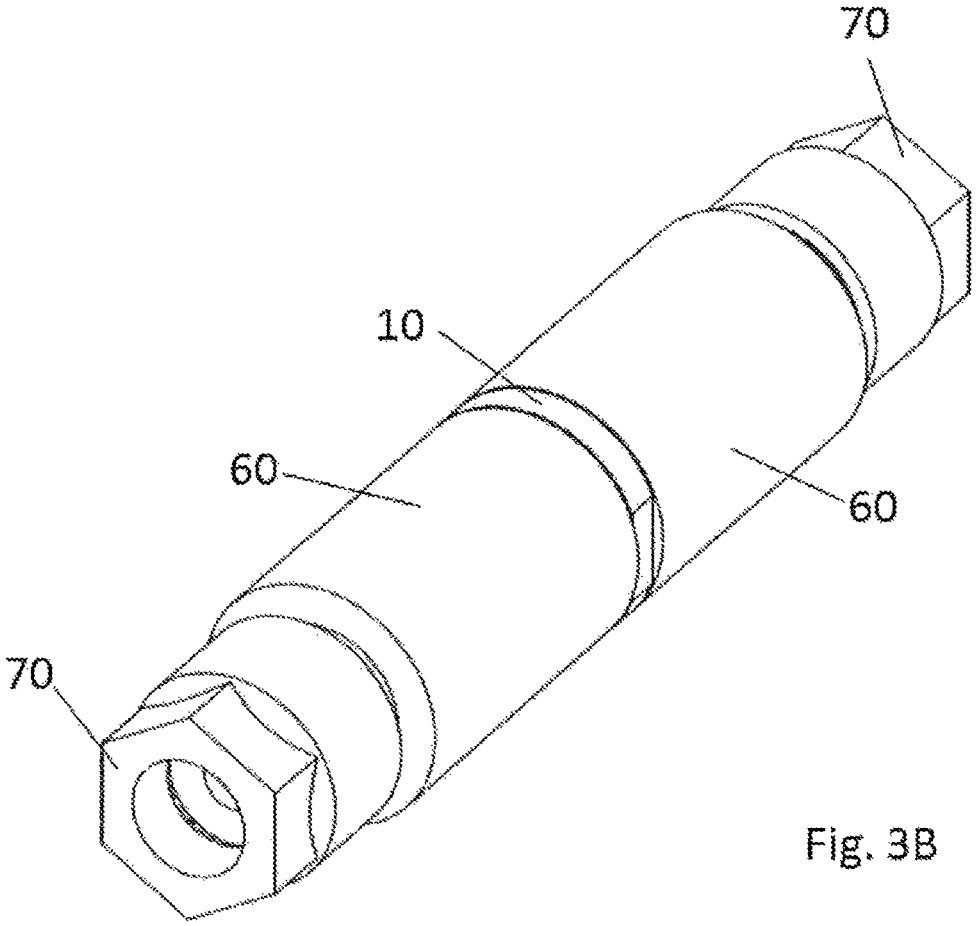
Figure 4:
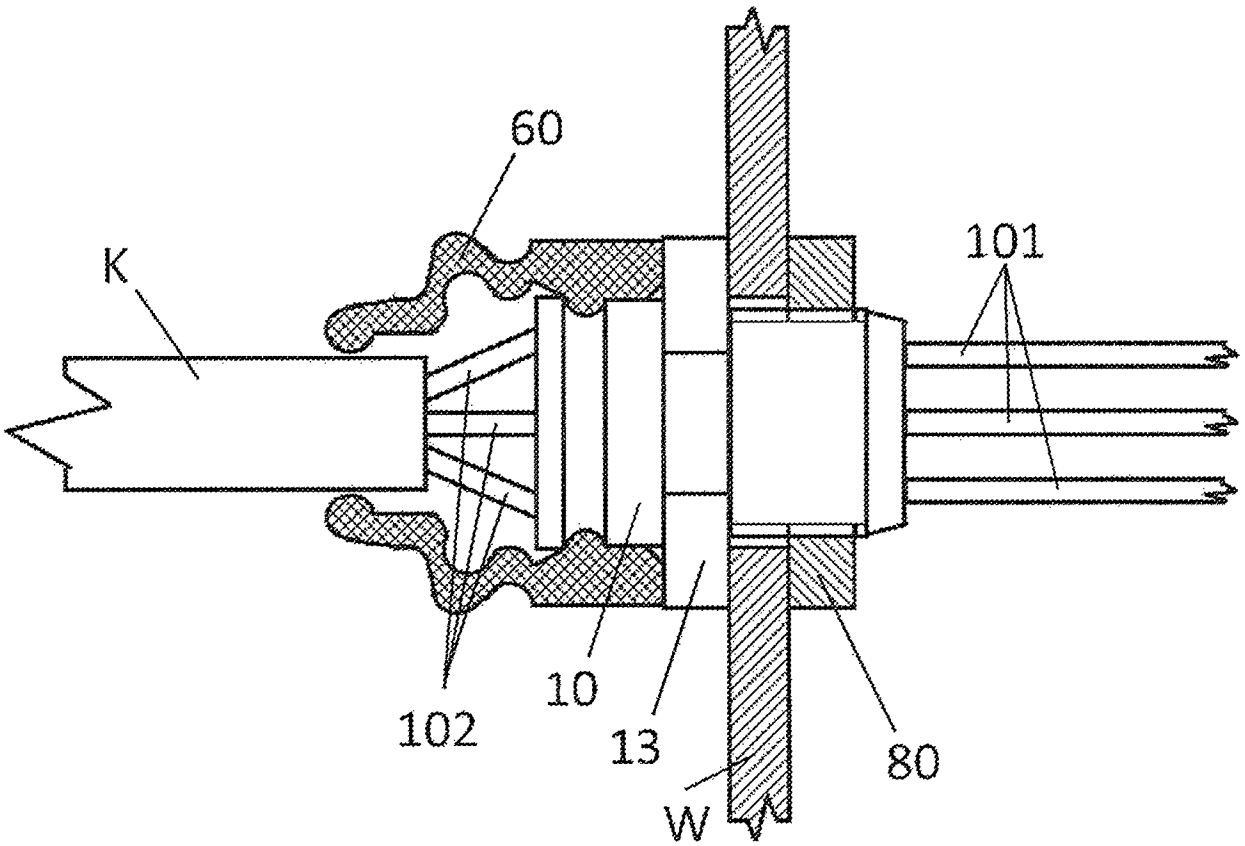

In the following, further advantages, details, and features of the invention shall be described using the depicted embodiments. They show in detail in:

FIG. 1A: a cross-sectional view of a cable connector according to the invention;

FIG. 1B: the cable connector shown in FIG. 1A with two electrical conductors connected by means of the cable connector;

FIG. 2A: a spatial depiction of the cable connector shown in FIG. 1A as seen from a field side;

FIG. 2B: the cable connector shown in FIG. 2A with disassembled slip-on sleeve;

FIG. 2C: a spatial depiction of the cable connector shown in FIG. 2A as seen from a device side;

FIG. 3A: a cross-sectional view of a cable connector according to the invention with two slip-on sleeves;

FIG. 3B: a spatial depiction of the cable connector shown in FIG. 3A; and FIG. 4: a cross-sectional view of a cable connector according to the invention according to a further embodiment.

In the description below, the same reference signs denote the same components or the same features, so that a description regarding a component with reference to a drawing also applies to the other drawings, thus avoiding a repetitious description. In addition, individual features described in connection with an embodiment can also be used separately in other embodiments.

FIG. 1A shows a cable connector 1 according to the invention for electrically connecting at least two electrical conductors 101 with second electrical conductors 102, the number of which corresponds to the number of first electrical conductors 101. FIG. 1A shows a cross-sectional view of the cable connector 1 with a cross section along a longitudinal axis L of the cable connector 1 without inserted first electrical conductors 101 and second electrical conductors 102. FIG. 1B shows the cable connector 1 depicted in FIG. 1A with the first electrical conductors 101 and second electrical conductors 102 inserted in the cable connector 1.

FIGS. 2A, 2B, and 2C show a spatial depiction of the cable connector shown in FIGS. 1A and 1B.

The cable connector 1 has an insulating-material housing 10 which, in the depicted embodiment, has three first conductor insertion openings 21 and three second conductor insertion openings 22. It can be seen that the second conductor insertion openings 22 are arranged opposite the first conductor insertion openings 21. More specifically, it can be seen that the first conductor insertion openings 21 and the second conductor insertion openings 22 are each introduced in opposite end faces 11, 12 of the insulating-material housing 10. FIGS. 1A and 1B further show that the respective first conductor insertion openings 21 are connected to the respective second conductor insertion openings 22 via a through-recess running through the insulating-material housing 10. The figures also show that a lid 15 is arranged on each of the end faces 11, 12 of the insulating-material housing 10 and connected to the insulating-material housing 10. The lids 15 have through-openings which are oriented correspondingly aligned with the first conductor insertion openings 21 and the second conductor insertion openings 22.

Furthermore, the cable connector 1 has electrical contacts 30 arranged in the insulating-material housing 10, the number of which corresponds to the number of first conductor insertion openings 21.

In this case, the respective electrical contacts 30 can each be electrically contacted via a first conductor insertion opening 21 by means of a first electrical conductor 101 and via a second conductor insertion opening 22 by means of a second electrical conductor 102. The respective first electrical conductors 101 can each be loaded against the electrical contact 30 by means of a first clamping spring 41. In addition, the second electrical conductors 102 can each be loaded against the electrical contact 30 by means of a second clamping spring 42. The respective first electrical conductors 101 are thus electrically connected to one second electrical conductor 102 each by means of an electrical contact 30.

It can be seen in FIGS. 1A and 1B that both the first clamping spring 41 and the second clamping spring 42 each have a contact limb 43 and a clamping limb 45 connected to said contact limb via a bending joint 44. It can also be seen that the respective electrical contacts 30 each have a stop section 33 and two contact sections 31, 32 connected to the stop section 33. In this case, the first contact section 31 extends in the direction of the first conductor insertion opening 21, and the second contact section 32 extends in the direction of the second conductor insertion opening 22. The respective contact limbs 43 of the first clamping spring 41 and the second clamping spring 42 each rest on the contact section 33 of the electrical contact 30.

Both the first electrical conductor 101 and the second electrical conductor 102 can be brought into electrical contact with the electrical contact 30 under elastic deformation of the clamping springs 41, 42 via the conductor insertion openings 21, 22. For that purpose, the respective clamping limbs 45 press onto the electrical conductors 101, 102 in the direction of the respective contact sections 31, 32 of the electrical contact 30.

The stop section 33 of the electrical contact 30 serves as a support for the respective contact limbs 43 of the first clamping spring 41 and the second clamping spring 42. The stop section 33 further serves as a stop for the first electrical conductor 101 and the second electrical conductor 102.

The cable connector 1 according to the invention further comprises first actuation devices 51, the number of which corresponds to the number of first clamping springs 41. The first actuation devices 51 can also be called first push-buttons 51. An actuation of a first actuation device 51 transfers the first clamping spring 41, which is in contact with said first actuation device, under elastic deformation to a release position, in which the first electrical conductor 101 is not loaded against the electrical contact 30 by means of the clamping limb 45 of the first clamping spring 41, so that the first electrical conductor 101 can be removed from the cable connector 1. Furthermore, the cable connector 1 also has second actuation devices 52 which can also be called second push-buttons 52, the number of which corresponds to the number of second clamping springs 42. An actuation of the second actuation device 52 also transfers the second clamping spring 42, which is in contact with said second actuation device, under elastic deformation to a release position, in which the second electrical conductor 102 is not loaded against the electrical contact 30 by means of the clamping limb 45 of the second clamping spring 42, so that the second electrical conductor 102 can be removed from the cable connector 1.

FIG. 2B shows that the three first conductor insertion openings 21 are arranged in an angle equidistant manner to one another. FIG. 2B further shows that the respective first actuation devices 51 have the same angular distance to one another as the first conductor insertion openings 21 to one another. In such case, the first actuation devices 51 have a radial distance to the first conductor insertion openings 21. More specifically, the radial distance of the first actuation devices 51 to the longitudinal axis L of the insulating-material housing 10 is greater than that of the respective first conductor insertion openings 21 to the longitudinal axis L of the insulating-material housing.

In FIG. 2C, it can be seen that the three second conductor insertion openings 22 are arranged in an angle equidistant manner to one another. FIG. 2C further shows that the respective second actuation devices 52 have the same angular distance to one another as the second conductor insertion openings 22 to one another. In such case, the second actuation devices 52 have a radial distance to the second conductor insertion openings 22. More specifically, the radial distance of the second actuation devices 52 to the longitudinal axis L of the insulating-material housing 10 is greater than that of the respective second conductor insertion openings 22 to the longitudinal axis L of the insulating-material housing.

For connecting the first electric cable 101 to second electric cables 102, the cable connector 1 according to the invention is guided through a wall W of an electrical device, wherein a fastening nut 80 is screwed onto a threaded section of the insulating-material housing 10. A first seal 91 is provided between a stop section 13 of the insulating-material housing 10 and the wall W.

The cable connector 1 further has a slip-on sleeve 60 which can be placed onto the insulating-material housing 10. The slip-on sleeve 60 has a cable seal 61 for sealing a cable K. A cable gland 70 is screwed onto an outer thread 62 of the slip-on sleeve 60. In addition, a second seal 92 is provided between the insulating-material housing 10 and the slip-on sleeve 60, and so a penetration of moisture from the outside through the cable connector 1 into the interior of a housing is prevented.

FIGS. 3A and 3B show a cable connector 1 which has two slip-on sleeves 60, wherein a first slip-on sleeve 60 is placed onto a first end of the insulating-material housing 10, and a second slip-on sleeve 60 is placed onto a second end of the insulating-material housing 10. Both the first slip-on sleeve 60 and the second slip-on sleeve 60 each have a cable seal 61 for sealing a cable K. One cable gland 70 each is screwed onto outer threads 62 of the respective slip-on sleeves 60. In addition, a second seal 92 is provided between the insulating-material housing 10 and the respective slip-on sleeves 60, and so a penetration of moisture from the outside through the cable connector 1 into the interior of a housing is prevented. The remaining structure of the cable connector 1 is identical with the structure of the cable connector shown with reference to FIGS. 1A to 2C.

The cable connector 1 shown in FIGS. 3A and 3B is particularly suitable for connecting at least one first electrical conductor 101 with at least one second electrical conductor 102 in the field. Therefore, the cable connector 1 does not necessarily have to be arranged in an opening of a wall/housing wall. The cable connector 1 shown in FIGS. 3A and 3B is thus designed to be used in the field, wherein the two electrical conductors 101, 102 to be connected are located freely in the field, i.e., for example, they are not arranged within a housing.

FIG. 4 shows a cross-sectional view of a cable connector 1 according to a further embodiment of the present invention. The cable connector 1 shown in FIG. 4 differs from the cable connectors 1 shown in the previous drawings in that the slip-on sleeve 60 is designed as an elastic or flexible slip-on sleeve 60. It can be seen that the slip-on sleeve 60 is designed as a bellows 60 which can adapt to a bending of a cable K in an improved manner. The remaining structure of the cable connector 1 is identical with the structure of the cable connectors 1 previously described.

Of course, it is also possible that the cable connector 1 has two elastically designed slip-on sleeves 60 which, as shown in FIGS. 3A and 3B, are arranged on two opposite sides of the cable connector 1.

LIST OF REFERENCE SIGNS

1 Cable connector
10 Insulating-material housing
11 first end face (of the insulating-material housing)
12 second end face (of the insulating-material housing)
13 Stop section (of the insulating-material housing)
14 Thread (of the insulating-material housing)
15 Lid
21 first conductor insertion opening
22 second conductor insertion opening
30 Electrical contact
31 first contact section (of the electrical contact)
32 second contact section (of the electrical contact)
33 Stop section (of the electrical contact)
41 first clamping spring

42 second clamping spring
43 Contact limb (of a clamping spring)
44 Bending joint (of a clamping spring)
45 Clamping limb (of a clamping spring)
51 first actuation device/first push-button
52 second actuation device/second push-button
60 Slip-on sleeve
61 Cable seal (of the slip-on sleeve)
62 Thread (of the slip-on sleeve)
70 Cable gland
80 Fastening nut
91 first seal
92 second seal
101 first electrical conductor/first electric cable
102 second electrical conductor/second electric cable
L Longitudinal axis (of the insulating-material housing)
K Electric cable
W Housing wall (of an electrical device)

The invention claimed is:

1. A cable connector for electrically connecting at least one first electrical conductor to at least one second electrical conductor, the cable connector comprising:

an insulating-material housing, which has at least two first conductor insertion openings and at least two second conductor insertion openings, arranged opposite the first conductor insertion openings, and a number of the at least two second conductor insertion openings corresponding to a number of the at least two first conductor insertion openings; and at least two electrical contacts arranged in the insulating-material housing, a number of the electrical contacts corresponding to the number of the at least two first conductor insertion openings, each of the at least two electrical contacts being arranged to be electrically contacted by respective first electrical conductors via one of the at least two first conductor insertion openings and by respective second electrical conductors via one of the at least two second conductor insertion openings;

wherein the respective first electrical conductors are each arranged to be loaded against the respective electrical contacts by respective first clamping spring and the respective second electrical conductors are each arranged to be loaded against the respective electrical contact by respective second clamping spring, so that the respective first electrical conductor is electrically connected to the respective second electrical conductor by the electrical contact;

wherein the cable connector further comprises first actuation devices, a number of the first actuation devices corresponding to a number of respective first clamping springs, wherein an actuation of a first actuation device transfers the respective first clamping spring, which is in contact with the first actuation device, under elastic deformation to a release position, in which the respective first electrical conductor is not loaded against the electrical contact by the respective first clamping spring, so that the respective first electrical conductor is removable from the cable connector, wherein the cable connector further comprises second actuation devices, a number of the second actuation devices corresponding to a number of respective second clamping springs, and wherein an actuation of a second actuation device transfers the respective second clamping spring, which is in contact with the second actuation device, under elastic deformation to a release position, in which the respective second electrical conductor is not loaded against the electrical contact by the respective second clamping spring, so that the respective second electrical conductor is removable from the cable connector.

2. The cable connector according to claim 1, further comprising at least one lid which is arranged on an end face of and connected to the insulating-material housing.

3. The cable connector according to claim 1, wherein:

the respective first electrical conductors are brought into electrical contact with an electrical contact under elastic deformation of the respective first clamping springs via the respective first conductor insertion openings; and the respective second electrical conductors are brought into electrical contact with an electrical contact under elastic deformation of the respective second clamping springs via the respective second conductor insertion openings.

4. The cable connector according to claim 1, wherein the at least two first conductor insertion openings have an angular distance to one another, and the at least two second conductor insertion openings have an angular distance to one another.

5. The cable connector according to claim 1, wherein:

the insulating-material housing has at least three first conductor insertion openings and at least three second conductor insertion openings; and the first conductor insertion openings are arranged in an angle equidistant manner to one another, and the second conductor insertion openings are arranged in an angle equidistant manner to one another.

6. The cable connector according to claim 1, wherein:

the first actuation devices have the same angular distance to one another as the first conductor insertion openings to one another;

the first actuation devices have a radial distance to the first conductor insertion openings;

the second actuation devices have a same angular distance to one another as the second conductor insertion openings to one another; and the second actuation devices have a radial distance to the second conductor insertion openings.

7. The cable connector according to claim 1, wherein the respective electrical contacts each have a stop section and two contact sections connected to the stop section, wherein a first contact section extends in the direction of a first conductor insertion opening, and a second contact section extends in the direction of a second conductor insertion opening.

8. The cable connector according to claim 1, wherein the respective first clamping springs and the respective second clamping springs each have a contact limb and a clamping limb connected to said contact limb via a bending joint.

9. The cable connector according to claim 8, wherein the contact limbs each rest on an electrical contact.

10. The cable connector according to claim 9, wherein the contact limbs of the first and second clamping springs each rest on a stop section of an electrical contact.

11. The cable connector according to claim 1, wherein the cable connector has at least one slip-on sleeve which can be placed upon the insulating-material housing.

12. The cable connector according to claim 11, wherein the at least one slip-on sleeve is designed as an elastic slip-on sleeve.

13. The cable connector according to claim 11, wherein the cable connector has a cable gland which can be screwed together with the slip-on sleeve.

* * * * *